343-700 MS AU 251 EX
7/10/84 OR 4,459,593

United States Patent [19]

Hall et al.

[11] Patent Number: 4,459,593

[45] **Date of Patent: * Jul. 10, 1984**

[54] STRIPLINE ANTENNAS

[75] Inventors: Peter S. Hall, Shrivenham; Colin Wood, Havant, both of England

[73] Assignee: The Secretary of State for Defence in Her Britannic Majesty's Government of the United Kingdom of Great Britain and Northern Ireland, London, England

[ * ] Notice: The portion of the term of this patent subsequent to Jun. 15, 1999 has been disclaimed.

[21] Appl. No.: 351,097

[22] Filed: Feb. 23, 1982

[30] Foreign Application Priority Data

Mar. 4, 1981 [GB] United Kingdom ..... 8106779

[51] Int. Cl.[3] ..... H01Q 1/38

[52] U.S. Cl. ..... 343/700 MS; 343/731

[58] Field of Search ..... 343/700 MS, 806, 846, 343/854, 731, 708

[56] References Cited

U.S. PATENT DOCUMENTS 3,231,894 1/1966 Nagai ..... 343/806
4,021,810 5/1977 Urpo et al. ..... 343/846
4,260,988 4/1981 Yanagisawa et al. ..... 343/700 MS
4,335,385 6/1982 Hall ..... 343/700 MS

FOREIGN PATENT DOCUMENTS 798821 7/1958 United Kingdom ..... 343/708

*Primary Examiner*—Eli Lieberman
*Attorney, Agent, or Firm*—Pollock, Vande Sande & Priddy

[57] ABSTRACT

Stripline antenna arrays of the type in which the strip turns through successive right-angle corners to form successive four-cornered cells, the lengths of the longitudinal and tranverse strip sections being such that the summed radiation in each cell has the same polarization direction, viz vertical, horizontal or circular, radiating in the broadside direction effect arbitrary polarization directions radiating in any direction in the plane (x-z) normal to the array which contains the array axis, by using cells having six potential right-angle corner sites and strip sections of appropriate lengths. The number of actual corners may reduce to four; e.g. where strip-section lengths reduce to zero.

4 Claims, 10 Drawing Figures

STRIPLINE ANTENNAS

This invention relates to stripline antennas, in particular to stripline antenna arrays.

In prior copending Hall U.S. application Ser. No. 55,259 filed July 6, 1979, for "Stripline Antennas" now U.S. Pat. No. 4,335,385 issued June 15, 1982, there are described forms of stripline antenna arrays in which a conducting strip on an insulating substrate having a conducting backing turns through successive quartets of right-angle corners, each corner radiating with diagonal polarization, to form a succession of four-cornered cells whereof corresponding corners radiate in phase and the summed radiation from each quartet has the same polarisation direction. The polarisation direction depends on the lengths of the transverse and longitudinal sections of the strip in each quartet in relation to the operating wavelength in the strip, and the said application Ser. No. 55,259 describes arrays in which these lengths produce vertical, horizontal or circular polarization respectively, all in a direction normal to the plane of the array, ie the so-called broadside radiation.

The present invention is based upon the discovery that the respective arrays described as aforesaid are particular cases of a more general relationship between the lengths of the strip sections and the operating wavelength therein, by means of which any arbitrary direction of polarization can be provided, in any direction in the plane normal to the plane of the array which contains the array axis.

According to the present invention a stripline antenna array comprises:

a strip of conducting material on an insulating substrate having a conducting backing;

said strip turning through successive right-angle corners to form a plurality of similar cells each notionally constituted by three equispaced transverse sections of the strip extending at right angles from the longitudinal axis of the array, the central transverse section extending both sides of said axis, and connected at their outward extremities by longitudinal sections of the strip to thereby provide six potential right-angle corner sites in each cell;

the lengths of the transverse sections extending either side of said axis, the length of said longitudinal sections, and the strip-length between successive cells being such, in relation to the operating wavelength in the strip (said transverse section lengths either one side of said axis, and said strip-length between successive cells, being reducible to zero) that when connected to a source of the operating frequency and operated in a travellingwave mode, the summed radiation from the actual right-angle corners in each cell has the same given polarization direction at a given angle to said longitudinal array axis in a longitudinal plane normal to the array plane and containing said array axis;

said polarization direction being other than transverse, axial or circular at an angle of 90° to the array axis in said longitudinal plane.

In particular the present invention provides an array as aforesaid wherein, in relation to said polarization direction and said angle to said array axis, the lengths of the transverse and longitudinal sections satisfy equation (2) hereinafter, and the strip-length between successive cells satisfies equation (11) hereinafter: in such an array where said polarization direction is elliptical (including circular), the lengths of the transverse and longitudinal sections satisfy equations (3) or (5) hereinafter (depending on the direction of rotation); where said polarization direction is linear, the lengths of the transverse and longitudinal sections satisfy equation (6) hereinafter.

In the aforesaid definition of the present invention the similar cells are said to be "notionally" constituted by three equispaced transverse sections of the strip and to have six "potential" right-angle corner sites per cell because in certain specific cases, eg the aforesaid case of broadside circular polarization, the lengths of the transverse sections on one or other side of the array axis reduce to zero. In this case, the actual (discernable) number of transverse sections per cell will be only two, viz extending one side only of the aforesaid axis; consequently in this case the number of actual (discernable) right-angle corners reduces to four. Similarly, in the aforesaid cases of broadside vertical and horizontal polarization, the transverse section lengths either side of the axis are equal and the strip-length between successive cells becomes zero, with the similar result that the resulting arrays can be divided into cells each having two actual (discernable) transverse sections (depending on how one arbitrarily defines the cell limits, as later shown with reference to FIGS. 3 and 4) and four right-angle corners.

In some cases the first and last cells of an array may have one more or one less actual (discernable) corner than the intervening cells; this may be unavoidable, eg in cases where the strip-length between successive cells in zero. However this minor departure from symmetry in the pattern of radiating corners will normally have no sensible effect on the radiation from the array as a whole.

To enable the nature of the present invention to be more readily understood, attention is directed by way of example, to the accompanying drawings wherein.

Figure 7:
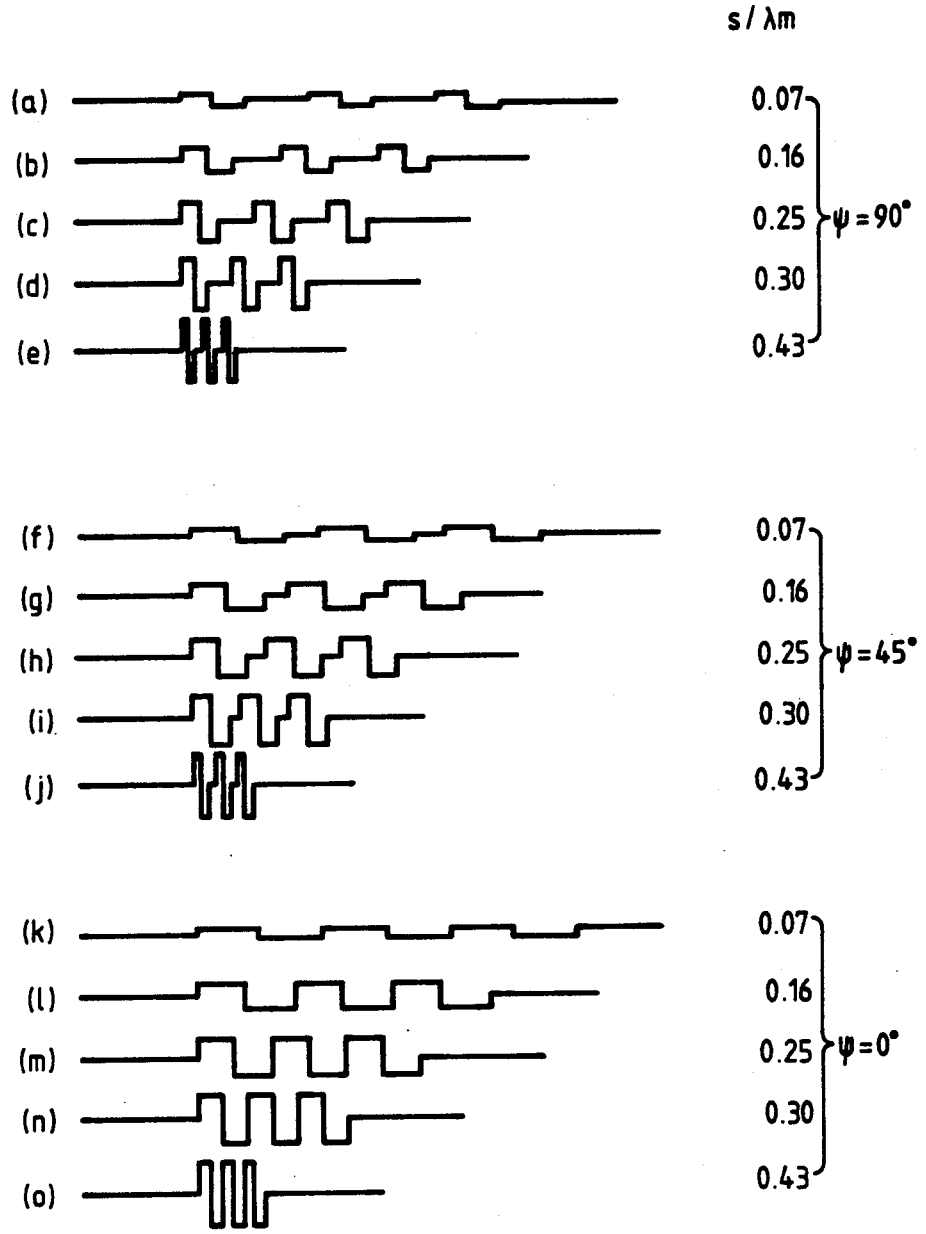

FIGS. 7(*a*) to (o) are simplified plan views of arrays having different values of $\psi$ and s (as hereinafter defined).

Figure 8:
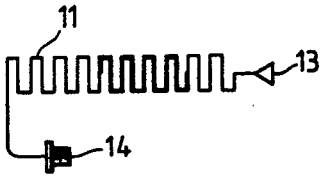

FIG. 8 is a plan view of a specific embodiment of the invention.

Figure 9:
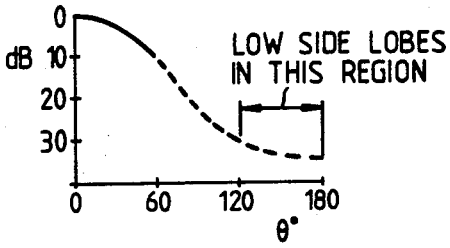
Figure 10:
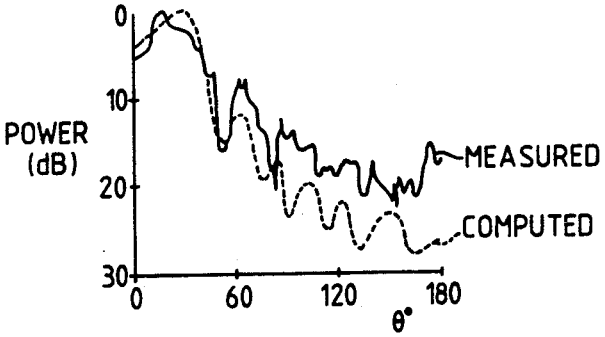

FIGS. 9 and 10 are curves showing respectively the desired and obtained coverage in the $\theta$ plane of the embodiment of FIG. 8.

Figure 1:
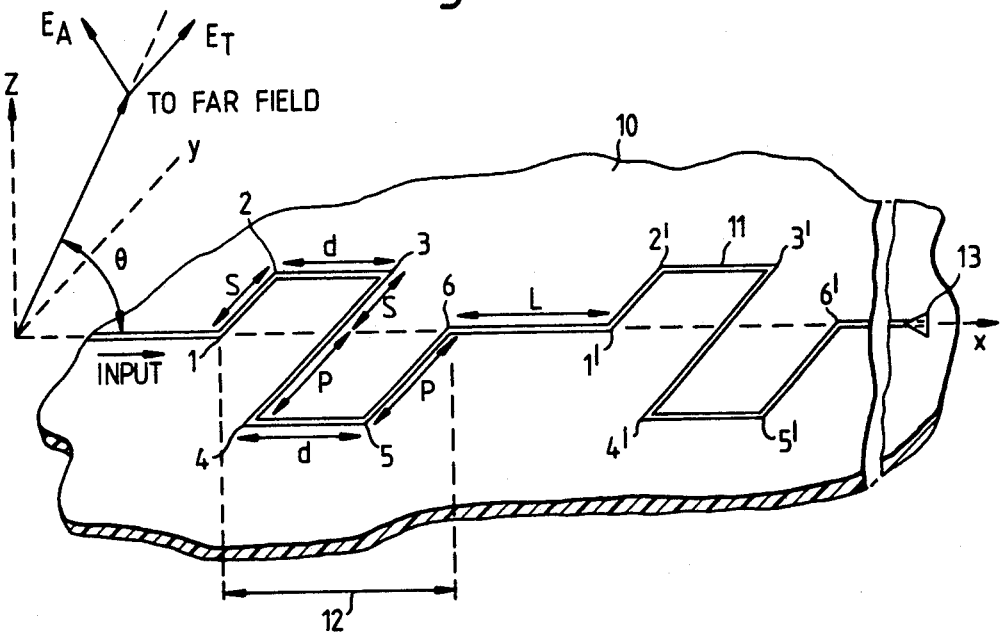
FIG. 1 is a perspective view of two cells of a stripline antenna array embodying the present invention.

Referring to FIG. 1, a dielectric sheet 10, originally metal-coated on both faces, has one face etched to form a stripline 11, leaving the other face to act as a groundplane (not shown). Starting from the longitudinal axis x of the resulting microstrip array, the strip 11 turns through six successive right-angle corners 1–6 to form a cell constituted by three equispaced transverse sections extending from the axis x, the first section being of length s, the second section extending back across axis x and being of length s+p, and the third section being of length p, whose outward extremities are connected by two sections of length d. This cell, whose extent is indicated by arrow 12, is joined to a succeeding similar cell having corners 1'–6' by a length of strip L, and the complete array, comprising a relatively large number of such cells, is terminated by a matched load 13.

As explained in the aforesaid application Ser. No. 55,259, the radiation from such right-angle corners is predominantly diagonal, and its equivalent circuit can be represented by the radiation conductance in parallel with a capacitative component. To reduce the latter component, the corners may be truncated as described therein.

Each cell shown in FIG. 1 can be considered as having a diagonally polarized magnetic dipole source at each right-angle corner, the dipoles being fed in phase progression to form a travelling-wave array. The field in the plane of the array length only will be considered, ie the x-z or $\theta$ plane in FIG. 1, where z is normal to the plane of the array. Thus, for example, the path-difference from sources 1 and 2 to a far-field point is zero. It can then be shown that the far-field components radiated in the $\theta$ (ie x-z) plane are $$E_T(\theta) = \frac{-4E}{\sqrt{2}} \sin\theta e^{-j\frac{2s+d}{2}\beta + j\frac{u}{2}} \left[ \sin\frac{s\beta}{2} \sin\left(\frac{s+d}{2}\beta - \frac{u}{2}\right) - e^{-j(s+d+p)\beta + ju} \sin\frac{p\beta}{2} \sin\left(\frac{d+p}{2}\beta - \frac{u}{2}\right)\right] \quad (1a)$$

$$E_A(\theta) = \frac{-4E}{\sqrt{2}} j e^{-j\frac{2s+d}{2}\beta + j\frac{u}{2}} \left[ \sin\frac{s\beta}{2} \cos\left(\frac{s+d}{2}\beta - \frac{u}{2}\right) + e^{-j(s+d+p)\beta + ju} \sin\frac{p\beta}{2} \cos\left(\frac{d+p}{2}\beta - \frac{u}{2}\right)\right] \quad (1b)$$

where E is the magnetic dipole strength, $E_T(\theta)$ is the transverse component of E (ie parallel to the x-y plane in FIG. 1) and $E_A(\theta)$ is the axial component of E (ie in the x-z plane and normal to $E_T$; thus for $\theta=90°$, $E_A$ is parallel to the array axis x, and for $\theta=0°$ $E_A$ is normal to the array axis x in the z direction), $u=-k_o d \cos\theta$, $\beta$ is the wave-number in the microstrip line ($\beta=2\pi/\lambda_m$ where $\lambda_m$ is the operating wavelength in the line), and $k_o$ is the wave-number in free space ($k_o=2\pi/\lambda_o$ where $\lambda_o$ is the free-space wavelength).

The polarization of the total field is given by the ratio of the above components, ie by $$\frac{E_T}{E_A} = -j\sin\theta \left[ \frac{\sin\frac{s\beta}{2}\sin\left(\frac{s+d}{2}\beta - \frac{u}{2}\right) - e^{-j(s+d+p)\beta + ju}\sin\frac{p\beta}{2}\sin\left(\frac{d+p}{2}\beta - \frac{u}{2}\right)}{\sin\frac{s\beta}{2}\cos\left(\frac{s+d}{2}\beta - \frac{u}{2}\right) + e^{-j(s+d+p)\beta + ju}\sin\frac{p\beta}{2}\cos\left(\frac{d+p}{2}\beta - \frac{u}{2}\right)} \right] \quad (2)$$

From equation (2) three particular cases can be derived.

Elliptical polarization, right-hand

This is obtained by making p=0 so that $$\frac{E_T}{E_A} = -j\sin\theta\tan\left(\frac{s+d}{2}\beta - \frac{u}{2}\right) \quad (3)$$

If $|E_T/E_A|=1$, right-hand circular polarization is obtained.

In this case, for $\theta=90°$ (the broadside direction)

$$\frac{s+d}{2}\beta = (n+1)\frac{\pi}{4}, \text{ for } n = 0, 2, 4, \ldots \quad (4)$$

For $|E_T/E_A|\neq 1$, any ellipticity can be obtained.

For $\theta\neq 90°$ equation (4) becomes $$\frac{s+d}{2}\beta - \frac{u}{2} = \tan^{-1}\left(\frac{1}{\sin\theta}\right) \quad (4a)$$

which has no such simple solution. It will be seen that for $\theta\neq 90°$, as $\theta$ changes the ellipticity also changes, and this limits the bandwidth obtainable for a given ellipticity.

Elliptical polarization, left-hand

This is obtained by making s=0 so that $$\frac{E_T}{E_A} j\sin\theta\tan\left(\frac{d+p}{2}\beta - \frac{u}{2}\right) \quad (5)$$

In this case if $|E_T/E_A|=1$, left-hand circular polarization is obtained, and for $\theta=90°$ (the broadside direction)

$$\frac{d+p}{2}\beta = (n+1)\frac{\pi}{4} \text{ for } n = 0, 2, 4, \ldots \quad (5a)$$

Again for $|E_T/E_A|\neq 1$, any ellipticity can be obtained, and for $\theta\neq 90°$, equation (5*a*) becomes $$\frac{d+p}{2}\beta - \frac{u}{2} = \tan^{-1}\left(\frac{1}{\sin\theta}\right) \quad (5b)$$

Linear polarization

This is obtained by making p=s so that $$\frac{E_T}{E_A} = \sin\theta\tan\left(\frac{s+d}{2}\beta - \frac{u}{2}\right)\tan\left(\frac{2s+d}{2}\beta - \frac{u}{2}\right) \quad (6)$$

The orientation of the polarization is controlled by varying the arguments of the tan functions. Two important cases are:

Linear transverse polarization (ie vertical polarization (VP))

Here $E_A=0$, so that (assuming $\sin\theta\neq 0$)

$$\left.\begin{array}{ll}\text{either} & (2s+d)\beta - u = \pi(n+1) \\ \text{or} & (s+d)\beta - u = \pi(n+1)\end{array}\right\} n = 0, 2, 4, \ldots \quad \begin{array}{r}(7)\\(8)\end{array}$$

Linear axial polarisation (ie horizontal polarization (HP))

Here $E_T=0$, so that $$\left.\begin{array}{ll}\text{either} & (2s+d)\beta - u = 2n\pi \\ \text{or} & (s+d)\beta - u = 2n\pi\end{array}\right\} n = 1, 2, 3, \ldots \quad \begin{array}{r}(9)\\(10)\end{array}$$

When $\sin\theta=0$, $E_T=0$ for any value of s or d.

In order to complete the definition of the array structure, the strip-length L between succesive cells is required. For the first corner-source in each cell to be in phase in the direction $\theta$, it can be shown that $$L = \frac{2(s+p+d)\beta - 2m\pi - 2k_o d\cos\theta}{k_o\cos\theta - \beta} \quad (11)$$

where m is an integer giving the smallest $L \geqq 0$. (It will be apparent that the expression of equation (11) may optionally include a further term, $+n\lambda_m$, where n=1, 2, 3 . . . , without affecting the required phase relationships, but as a practical matter this gives no apparent advantage and may give rise to grating lobes).

It will now be shown that the above-described general six-cornered structure of FIG. 1 will reduce to the specific fourcornered structures described in the aforesaid application Ser. No. 55,259 which give vertical, horizontal or circular polarization in the broadside direction, ie for $\theta=90°$.

Circular polarization (CP) (right hand)

p=0 and $|E_T/E_A|=1$, so that from equation (4)

$$s + d = \frac{\lambda_m}{4}(n+1)$$

Putting n=2 and $d=\lambda_m/4$, then $s=\lambda_m/2$.

From equation (11) with m=2, then $L=\lambda_m/2$.

Figure 2:
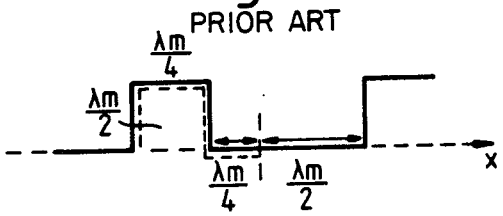
Fig.2. PRIOR ART
FIGS. 2, 3 and 4 are simplified plan views of cells of three prior-art arrays producing respectively circularly, vertically and horizontally polarized broadside radiation to illustrate their derivation from FIG. 1.
Figure 4:
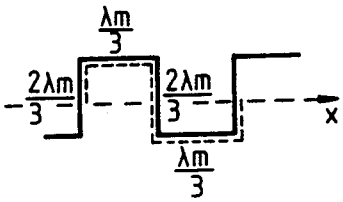
Fig.4. PRIOR ART

FIG. 1 thus reduces to FIG. 2 (extent of single cell shown dashed), which corresponds to FIG. 4 of the application Ser. No. 55,259.

(For left-hand circular polarization s=0 so that the $\lambda_m/2$ sections extend below the x axis of the array).

Linear polarization (VP)

p=s and $E_A=0$, so that from equation (7)

$$(2s+d) = \frac{\lambda_m}{2}(n+1)$$

Putting n=0 and $d=\lambda_m/4$, then $s=p=\lambda_m/8$.

From equation (11) with m=1, then L=0.

Figure 3:
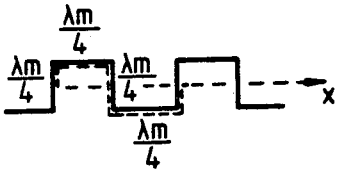
Fig.3. PRIOR ART

FIG. 1 thus reduces to FIG. 3, which corresponds to FIG. 2 of the application Ser. No. 55,259. (The extent of each single cell in the present FIG. 3 (shown dashed) is defined differently from in the aforesaid FIG. 2 for clarity, but the resulting array structures are identical.)

Linear polariation (HP)

p=s and $E_T=0$, so that from equation (9)

$$(2s+d)=n\lambda_m$$

Putting n=1 and $d=\lambda_m/3$, then $s=p=\lambda_m/3$.

From equation (1) with m=2, L=0.

FIG. 1 thus reduces to FIG. 4, which corresponds to FIG. 3 of the application Ser. No. 55,259. (The above comment about defining the extent of each cell applies here also, and less markedly to present FIG. 2.)

The above three specific structures already described in prior U.S. application Ser. No. 55,259 are excluded from the scope of the present invention.

Arbitrary elliptical polarization

Arbitrary elliptical polarisation is obtained by putting $E_T/E_A=jE$, where E is the ellipticity, into equation (3). Thus for the broadside direction ($\theta=90°$)

$$E = \tan\frac{s+d}{2}\beta \quad (12)$$

Figure 5:
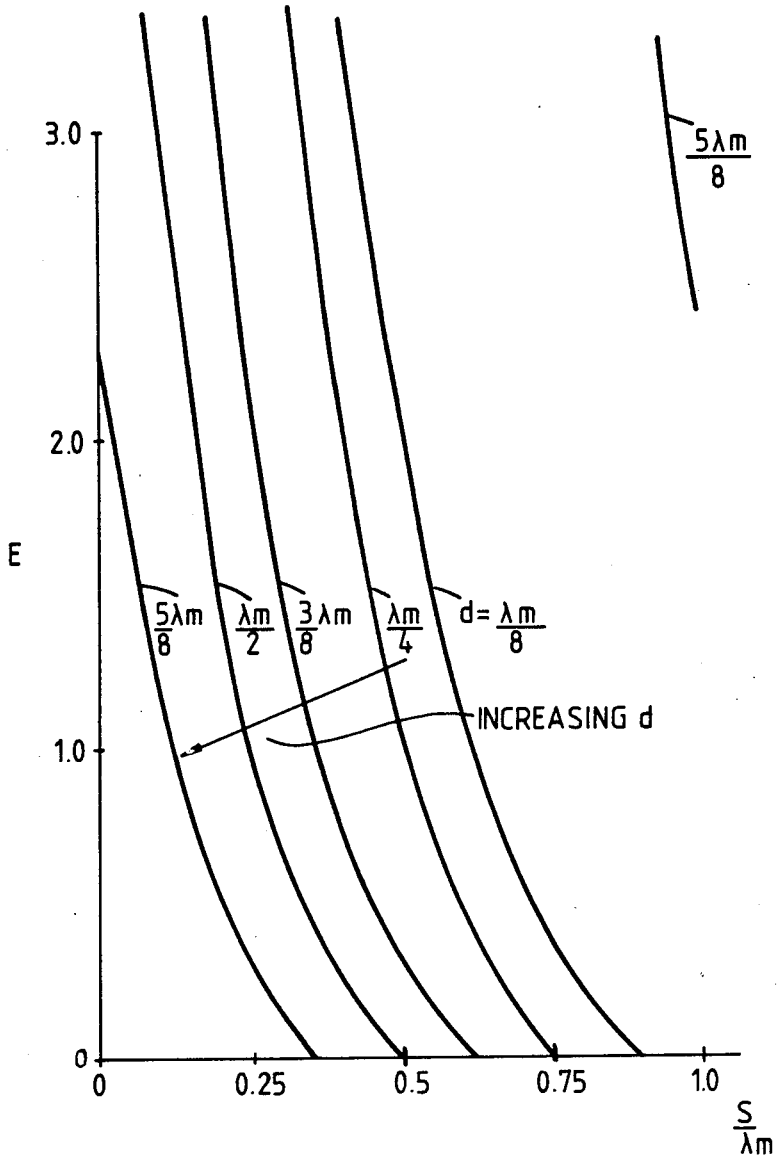
FIG. 5 is a family of curves relating E to s for various values of d (as hereinafter defined).

For a given d, equation (12) allows E to be selected by appropriate choice of s. The major axis of the polarization ellipse lies along the direction of either $E_A$ or $E_T$, depending the value of E. Curves of E against s for various values of d are plotted in FIG. 5.

Arbitrary linear polarization

Figure 6:
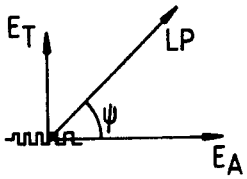
FIG. 6 shows the derivation of an angle $\psi$ (as hereinafter defined).

From equation (6) putting $\theta=90°$ and $E_T/E_A=\tan\psi$, then $$\tan\psi = \tan\left(\frac{s+d}{2}\beta\right)\tan\left(\frac{2s+d}{2}\beta\right) \quad (13)$$

where $\psi$ is defined in FIG. 6, in which LP indicates the linear polarization direction (of the broadside radiation) parallel to the plane (x-y) of the array (indicated at the origin of the Figure).

Equation (13) can be solved numerically, and some values of $d/\lambda_m$ for given values of $s/\lambda_m$ and $\psi$ are given in the following Table:

| $s/\lambda_m$ <br> $\psi$ (deg) | 0.3 | 0.25 | 0.1 | 0.07 | 0.03 |
|---|---|---|---|---|---|
| 0 | 0.29 | 0.50 | 0.66 | 0.85 | 0.94 |
| 30 | 0.26 | 0.40 | 0.56 | 0.68 | 0.74 |
| 60 | 0.23 | 0.34 | 0.46 | 0.60 | 0.66 |
| 90 | 0.16 | 0.25 | 0.30 | 0.43 | 0.47 |

FIGS. 7(*a*)–(*o*) show some typical structures, drawn to the same scale, derived from equation (13) and by putting m=2 in equation (11). (This value of m has not necessarily optimized the structure in all cases). Each Figure shows three successive cells, although in practice an array will have many more than three cells, eg. ten. In FIGS. 7(*a*)–(*j*) each cell has six actual corners; in FIGS. 7(*k*)–(*o*) these reduce to four actual corners because the inter-cell strip-length reduces to zero.

The distribution of power radiated across the aperture constituted by the array can be varied in the manner described in the aforementioned U.S. application Ser. No. 55,259 with reference to FIG. 5 thereof, ie by making the strip-width increase progressively towards the center so that more power is radiated from the center. Alternatively, this effect can be obtained in the manner described in copending U.S. patent application Ser. No. 351,099 of even date and identical title by the present applicants in which the cell dimensions are varied progressively towards the center.

One array embodying the invention is shown in silhouette in FIG. 8, in which the power distribution across the aperture is controlled by increasing the strip-width towards the center. The aim was an HP array giving the coverage in the $\theta$ plane indicated in FIG. 9, having low side-lobes in the region $120° < \theta < 180°$. In order to suppress cross-polarized grating lobes, d is kept small; here $2s/d=3$ and hence $2s=0.56\lambda_m$ from equation (9) with $n=1$ and $\theta=0$. Although the use of equation (9) (and similarly (10)) is not strictly necessary to give $E_T=0$ at $\theta=0$, its use will ensure $E_T \approx 0$ for small values of $\theta$. The strip-width and correction to account for the corner susceptance are determined empirically. The position of the coaxial output connector 14 and the match thereto are important in this embodiment, as unwanted radiation from the connector, and the reflected wave created by any mismatch, are found to limit the achievable side-lobe level. FIG. 8 shows the optimum connector position.

Versions of this embodiment having ten cells (as shown in FIG. 8), twenty cells and thirty cells respectively gave reduced side-lobe levels as the array length, and hence the peak gain, was increased, as shown in the Table below:

| No of Cells | Array length ($\lambda_o$) | Measured side-lobe level (dB) $120° < \theta < 180°$ |
|---|---|---|
| 10 (FIG. 8) | 3.1 | −15.0 |
| 20 | 6.2 | −16.0 |
| 30 | 9.3 | −21.0 |

FIG. 10 shows the actual coverage in the $\theta$ plane obtained with the ten-cell version (FIG. 8), which may be compared with the desired coverage shown in FIG. 9.

It will be appreciated that, although described in relation to their use as transmitting arrays, the present antennas can, as normal, also be used for receiving.

We claim:

1. A strip-line array having a longitudinal axis and comprising:

a strip of conducting material on an insulating substrate having a conducting backing;

said strip turning through successive right-angle corners to form a plurality of cells each defined mathematically by the lengths, in relation to the operating wavelength in the strip, of:

three equispaced transverse sections (a) extending at right angles from said axis, the central transverse section extending both sides of said axis; and two longitudinal sections (b) connecting the outward extremities of said transverse sections; said strip also including:

a longitudinal section (c) between successive cells;

the lengths of the transverse sections (a) either on one side only of the axis having a value in the range from zero upwards, and the length of the longitudinal section (c) also having a value in the range from zero upwards whereby each cell has either four or six said corners depending on said values;

the lengths of the transverse sections (a), of the longitudinal sections (b) and of the longitudinal section (c) being such that when connected to a source of the operating frequency and operated in a travelling-wave mode, the summed radiation from the right-angle corners in each cell has the same polarization direction at a given angle to said array axis in a longitudinal plane normal to the array plane and containing said array axis;

said lengths being other than such as to form a cell which produces a transverse, axial or circular direction of polarization at an angle of 90° to the array axis in said longitudinal plane.

2. An array as claimed in claim 1 wherein, in relation to said polarization direction and said angle to the array, the lengths of the transverse and longitudinal sections satisfy the equation:

$$\frac{E_T}{E_A} = -j\sin\theta \left[ \frac{\sin\frac{s\beta}{2}\sin\left(\frac{s+d}{2}\beta - \frac{u}{2}\right) - e^{-j(s+d+p)\beta+ju}\sin\frac{p\beta}{2}\sin\left(\frac{d+p}{2}\beta - \frac{u}{2}\right)}{\sin\frac{s\beta}{2}\cos\left(\frac{s+d}{2}\beta - \frac{u}{2}\right) + e^{-j(s+d+p)\beta+ju}\sin\frac{p\beta}{2}\cos\left(\frac{d+p}{2}\beta - \frac{u}{2}\right)} \right]$$

and the strip-length between successive cells satisfies the equation:

$$L = \frac{2(s+p+d)\beta - 2m\pi - 2k_o d\cos\theta}{k_o\cos\theta - \beta}$$

where:

$E_T$ is the transverse component of the polarization direction, $E_A$ is the axial component of the polarization direction, $\theta$ is the angle to the array longitudinal axis in a longitudinal plane normal to the array plane and containing the array axis, s and p are the lengths of the transverse sections (a) extending respective sides of the array longitudinal axis, d is the length of the longitudinal sections (b) connecting the outward extremities of the transverse sections, $\beta$ is $2\pi/\lambda_m$ where $\lambda_m$ is the operating wavelength in the strip, u is $-k_o d \cos\theta$ where $k_o=2\pi/\lambda_o$, $\lambda_o$ being the free-space wavelength at the operating frequency, j is the operator $\sqrt{-1}$, L is the length of the longitudinal section (c) between successive cells, and m is an integer giving the smallest value of L which is $\geqq 0$.

3. An array as claimed in claim 2 wherein said polarization direction is elliptical (including circular) and the lengths of the transverse and longitudinal sections satisfy either the equation:

$$\frac{E_T}{E_A} = -j\sin\theta\tan\left(\frac{s+d}{2}\beta - \frac{u}{2}\right)$$

or the equation:

$$\frac{E_T}{E_A} = j\sin\theta\tan\left(\frac{d+p}{2}\beta - \frac{u}{2}\right)$$

depending upon the direction of rotation.

4. An array as claimed in claim 2 wherein said polarization direction is linear and the lengths of the transverse and longitudinal sections satisfy the equation:

$$\frac{E_T}{E_A} = \sin\theta\tan\left(\frac{s+d}{2}\beta - \frac{u}{2}\right)\tan\left(\frac{2s+d}{2}\beta - \frac{u}{2}\right)$$

* * * * *